US007493868B1

(12) United States Patent
Arnal et al.

(10) Patent No.: US 7,493,868 B1
(45) Date of Patent: Feb. 24, 2009

(54) CATAMARAFT ALONGSIDE SHIP COUPLING SYSTEM

(75) Inventors: David B. Arnal, Cherry Hill, NJ (US); Dana L. Day, Turnersville, NJ (US); Edward M. Brennan, Wenonah, NJ (US)

(73) Assignee: Lockheed Martin Corporation, Bethesda, MD (US)

( * ) Notice: Subject to any disclaimer, the term of this patent is extended or adjusted under 35 U.S.C. 154(b) by 138 days.

(21) Appl. No.: 11/485,918

(22) Filed: Jul. 13, 2006

Related U.S. Application Data

(60) Provisional application No. 60/708,624, filed on Aug. 16, 2005.

(51) Int. Cl.

| | |
|---|---|
| ***B63B 21/58*** | (2006.01) |
| *E02B 3/24* | (2006.01) |
| *B63B 21/00* | (2006.01) |
| *B63B 21/56* | (2006.01) |
| *B63B 3/08* | (2006.01) |
| *B63B 9/00* | (2006.01) |
| *B63B 9/04* | (2006.01) |

(52) U.S. Cl. ..... 114/249; 114/250; 114/230.15; 114/230.17; 114/230.18; 114/230.19; 114/77 R; 114/242

(58) Field of Classification Search ..... 114/77 R, 114/230.15–230.19, 249, 250, 242; 414/138.2–138.4
See application file for complete search history.

(56) References Cited

U.S. PATENT DOCUMENTS

| | | | | |
|---|---|---|---|---|
| 3,353,512 | A * | 11/1967 | Kawerninski et al. | 114/250 |
| 3,945,508 | A | 3/1976 | Colin | |
| 4,003,473 | A | 1/1977 | Ryan | |
| 4,080,921 | A * | 3/1978 | Freitag | 114/249 |
| 4,176,615 | A * | 12/1979 | Reid et al. | 441/3 |
| 4,177,964 | A * | 12/1979 | Hujsak et al. | 244/172.4 |
| 4,327,784 | A | 5/1982 | Denniston | |
| 4,395,160 | A | 7/1983 | deJong | |
| 4,408,943 | A * | 10/1983 | McTamaney et al. | 137/899.2 |
| 4,441,448 | A * | 4/1984 | Hillberg | 441/3 |
| 4,442,943 | A | 4/1984 | Triplett | |
| 4,494,475 | A * | 1/1985 | Eriksen | 114/230.14 |
| 4,588,150 | A * | 5/1986 | Bock et al. | 244/172.4 |
| 4,854,800 | A | 8/1989 | Frick et al. | |

(Continued)

FOREIGN PATENT DOCUMENTS

| | | |
|---|---|---|
| GB | 2140769 | 12/1984 |

*Primary Examiner*—Lars A Olson
*Assistant Examiner*—Daniel V Venne
(74) *Attorney, Agent, or Firm*—Duane Morris LLP

(57) ABSTRACT

A system is provided for rigidly attaching a supply ship to a receiving ship to facilitate efficient transport of materials there-between even when the vessels are subject to heavy seas and weather. A telescoping truss assembly is provided on the first ship, and has a distal end configured to mate with a receptacle assembly on the second ship. Cables are disposed within the truss and are used to draw the truss and receptacle assemblies into engagement with each other. Once the assemblies are engaged, a hydraulic system is used to draw the two ships together, rigidifying the truss assembly and fixing the two ships in a "catamaran" arrangement. Subsequent transfers of materials between the ships can be carried out without the need to compensate for the relative dynamic vertical and horizontal displacements between the ships due to wind and waves.

20 Claims, 9 Drawing Sheets

U.S. PATENT DOCUMENTS

| | | | | |
|---|---|---|---|---|
| 4,905,938 | A | 3/1990 | Braccio et al. | |
| 4,947,778 | A | 8/1990 | Fahrner | |
| 6,064,924 | A | 5/2000 | Fleischmann | |
| 6,269,763 | B1 | 8/2001 | Woodland | |
| 6,435,795 | B1 | 8/2002 | Brady | |
| 6,523,783 | B2 | 2/2003 | Lounge et al. | |
| 6,659,703 | B1 | 12/2003 | Kirkley | |
| 6,811,368 | B1 | 11/2004 | Blank et al. | |
| 6,817,914 | B2 | 11/2004 | Breivik | |
| 6,826,452 | B1 | 11/2004 | Holland et al. | |
| 6,955,134 | B2 * | 10/2005 | Prins | 114/230.17 |
| 2003/0061960 | A1 | 4/2003 | Kunczynski | |

* cited by examiner

CATAMARAFT ALONGSIDE SHIP COUPLING SYSTEM

CROSS-REFERENCE TO RELATED APPLICATIONS

This application claims the benefit of the priority date of Provisional Application No. 60/708,624, filed Aug. 16, 2005.

FIELD OF THE INVENTION

The present invention relates to the field of coupling systems between ships to allow replenishment while underway.

BACKGROUND

Underway Replenishment is the method by which supplies are transferred from one ship to another at sea to enable a ship to remain at sea for prolonged periods of time. One current method of underway replenishment involves rigging a cable between the supply ship and the receiving ship and sending supplies over a wire using a trolley system.

An ideal scenario for transfer would be what is referred to as "skin-to-skin" replenishment, which is conducted by transferring material from two ships located directly next to each other. Currently this is possible only when the involved ships are at anchor or are moving at slow speeds in calm seas, due to the forces of water acting between the vessels, and the danger of the vessels colliding even while not making way. This method would be ideal for transfers at higher sea states because it would allow the transfer of supplies in 20 foot containers using standard crane systems. While skin-to-skin replenishment is not possible under all conditions and with all situations, increased capabilities for situations with higher sea states are desired.

One alternative is to develop a crane system that is capable of compensating for the relative movement between ships. However, such systems are highly complex and still may not be safe for transferring containers at higher sea states.

Alternatively, if the supplying and receiving ships can be rigidly attached, materials can be transferred from one ship to the other much more efficiently than previous systems, since complex crane systems would not be required. Larger, heavier loads could be transferred at relatively higher rates from hull to hull if a "catamaran" configuration were achieved between the ships. Further, it is expected that material transfers could be made at sea states of up to 4 or higher.

Accordingly, there is a need for a device which can securely and safely connect two large cargo ships at sea, in conditions of up to sea state 4 or higher, so that transfer of standard 20-foot containers ship-to-ship by crane can be performed.

SUMMARY OF THE INVENTION

A system for connecting first and second floating bodies is disclosed. The structure can comprise a truss assembly attached to the first floating structure; and a receptacle assembly attached to the second floating structure. The truss assembly may comprise first and second truss portions and a longitudinal axis, and the first truss portion may be slidably connected to the second truss portion along the longitudinal axis. The first truss portion further may have a coupling disposed at a distal end thereof for engagement with the receptacle assembly. The second truss portion may be connected at a proximal end thereof to the first floating structure via an adjustment assembly, the adjustment assembly being configured to allow the truss assembly to rotate about three mutually perpendicular axes with respect to the first floating body.

A system for connecting first and second floating bodies is disclosed, comprising a truss portion connected to the first floating body via a first adjustable assembly, and a receptacle portion connected to the second body via a second adjustable assembly. The truss portion can comprise first and second truss members. The first truss member can have a first end slidably engaged with the second truss member and a second end having a coupling element for engaging a corresponding recess in the receptacle portion. The first and second adjustable assemblies may each be configured to allow movement about three mutually perpendicular axes.

A method of connecting first and second floating bodies is disclosed. The method may include the steps of: providing a first ship with a truss assembly comprising first and second telescopically interrelated truss members, the truss assembly having an extended position and a retracted position; providing a second ship with a receptacle assembly comprising a recess for engaging the truss assembly; configuring the truss assembly to the extended position; engaging the truss assembly with the receptacle assembly; locking the truss assembly to the receptacle assembly; and configuring the truss assembly to the retracted position, thereby locking the first and second floating bodies together in a first direction.

BRIEF DESCRIPTION OF THE DRAWINGS

These and other features and advantages of the present invention will be more fully disclosed in, or rendered obvious by, the following detailed description of the preferred embodiment of the invention, which is to be considered together with the accompanying drawings wherein like numbers refer to like parts, and further wherein.

DETAILED DESCRIPTION

Figure 1:
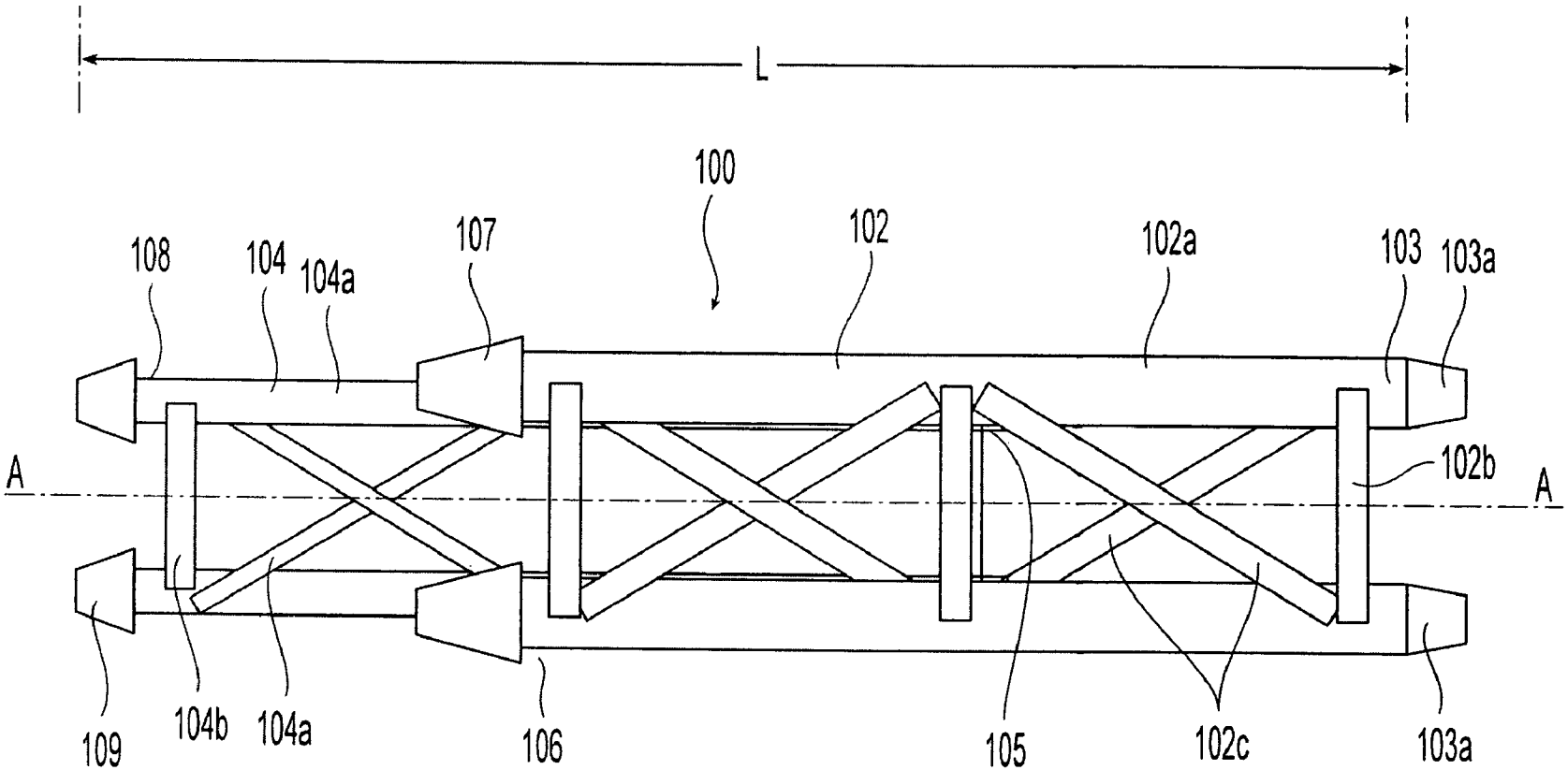
FIG. 1 is a side view of a pair of truss members of the coupling system of the present invention.

In the accompanying drawings, like items are indicated by like reference numerals.

This description of the preferred embodiments is intended to be read in connection with the accompanying drawings, which are to be considered part of the entire written description of this invention. In the description, relative terms such as "lower," "upper," "horizontal," "vertical,", "above," "below,"

"up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

The present invention comprises a system of telescoping trusses, winches and receptacles that can be used to couple ships in a temporary catamaran configuration in order to allow cargo to be transferred therebetween. The term "catamaran" in the context of this application shall mean at least two hulls connected together by at least one spacing member. The ships involved in the operation can sail alongside each other in close formation (e.g. within 50-75 feet). One ship can be provided with an extendable telescoping truss assembly 100, while the other ship can have a cooperating receptacle assembly 300. The telescoping truss assembly 100 can be attached to one of the ships (e.g. the supplying ship), while the corresponding receptacle assembly 300 can be attached to the other ship (e.g. the receiving ship). Further, one or both assemblies can be adjustably mounted to its respective ship using, for example, an adjustment assembly 200 (FIGS. 2, 7*a-c*) that may allow the truss assembly to move with respect to both ships during the initial engagement phase between the truss and receptacle assemblies 100, 300 (i.e. before the ships are "locked" together). This adjustability may facilitate a smooth and orderly connection process between the ships 1000, 2000.

Additionally, cables 500 can be disposed within the truss assembly 100 and can be passed from one ship to the other using known techniques. The cables 500 can be permanently stowed within the truss assembly 100 (for example, they may be retractably positioned within one or more of the longitudinal structural elements 104*a*, and then dispensed through the center of the associated coupling members 109 at the appropriate time). Once the cables 500 are attached to the receptacles, load sensing winches located on one of the ships can draw the truss assembly 100 into engagement with the receptacle assembly. A hydraulic ram system can then be used to draw the telescoping sections of the truss assembly together to form a stronger, axially compact configuration that will maintain nearly skin-to-skin positioning of the two vessels. It is expected that for large ships, maintaining this skin-to-skin positioning may require the use of a plurality of truss/receptacle assembly pairs 100, 300, with at least one pair located near the bow and at least one pair located near the stem of each ship. In one embodiment, a control system utilizing a laser and target system can be provided to steer the truss assembly 100 into initial engagement with the receptacle assembly 300.

Figure 2:
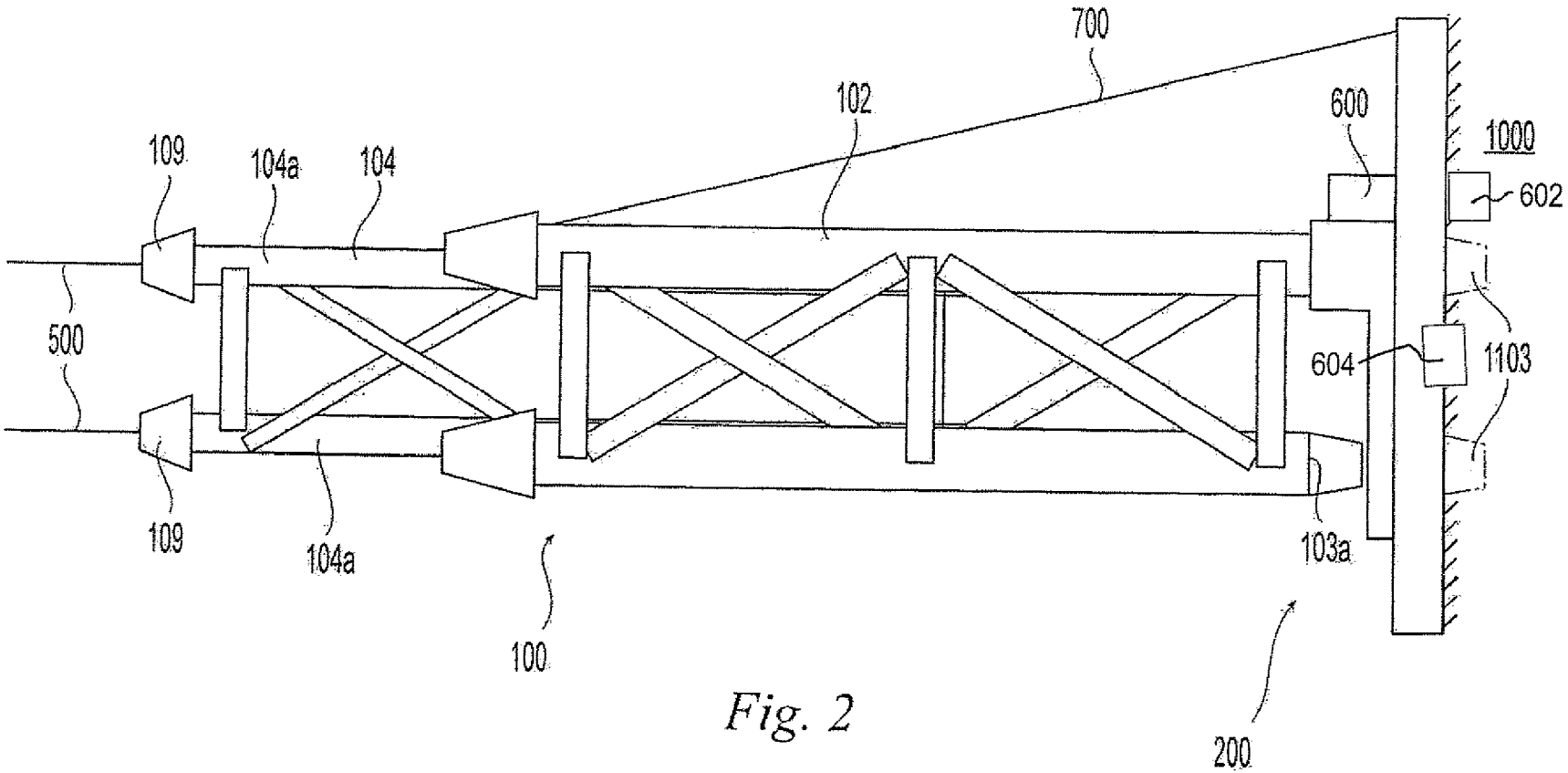
FIG. 2 is a side view of the truss members of FIG. 1, further including a cabling and gimbal arrangement of the coupling system of the present invention.
Figure 3:
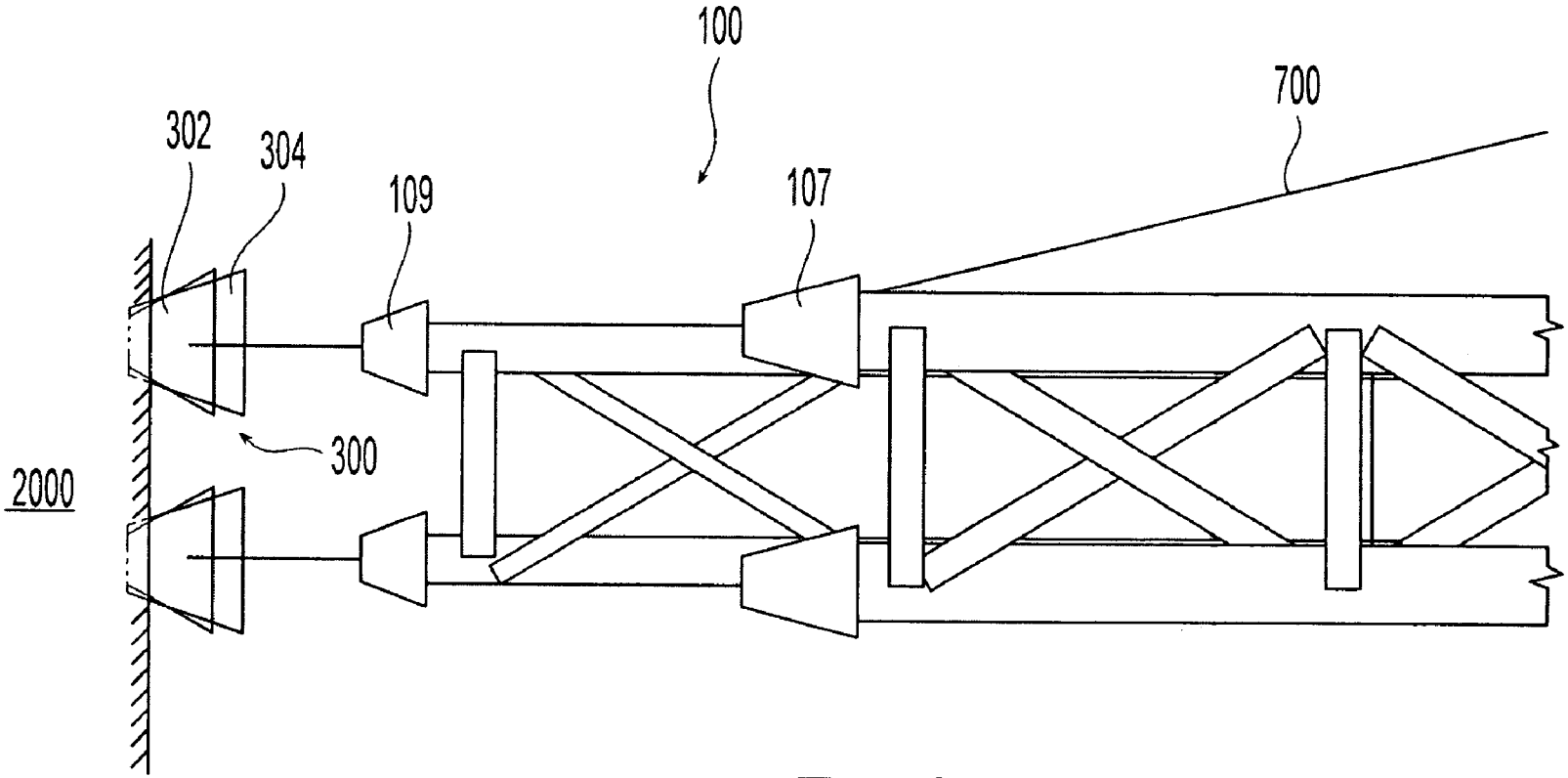
FIG. 3 is a partial side view of the pair of truss members and cabling arrangement of FIG. 2, and further showing preliminary engagement with receptacle arrangement.

Referring to FIG. 1, truss assembly 100 may comprise first and second truss members 102, 104 connected in telescopic relation. The truss assembly 100 may also have an effective total length "L" and an extension axis A-A along which at least one of the members 102, 104 is movable. The first truss member 102 may have a first end 103 configured to engage an adjustment assembly 200 (FIG. 2) associated with a first ship 1000 (FIG. 2). The adjustment assembly 200 may be capable of allowing rotation of the truss assembly 100 about three mutually perpendicular axes (x, y, z—see FIGS. 7*a-c*) with respect to the ship 1000. An opposite second end 106 may be provided with at least one coupling member 107 for engaging a corresponding receptacle element 302 (FIG. 3) associated with a second ship 2000 (FIG. 3). The second truss member 104 may have a first end 105 disposed adjacent to the adjustment assembly 200 of the first ship 1000 and a second end 108 provided with at least one coupling member 109 for engaging a corresponding receptacle element 304 associated with the second ship 2000 (FIG. 3). The receptacle elements 302, 304 may be connected to a receptacle assembly 300 associated with the second ship 2000. In the illustrated embodiment, the receptacle assembly 300 is fixed to the hull of the second ship 2000. As will be explained in greater detail later with regard to FIGS. 8*a-c*, receptacle assembly 300 alternatively may be mounted to an adjustment assembly 400 capable of allowing rotation of the receptacles 302, 304 about three mutually perpendicular axes (x, y, z—see FIGS. 8*a-c*) with respect to the second ship 2000.

In the illustrated embodiment, the coupling members 107, 109 are conical elements configured to couple with corresponding conically shaped receptacle elements 302, 304. The coupling members 107, 109 are also spaced apart appropriately so that they will register with the complementary receptacle elements 302, 304. It is noted that although the coupling members and receptacle elements are shown as being conical, they could assume other appropriate geometric shapes, and/or configurations as desired.

In the illustrated embodiment, the truss members 102, 104 each comprise at least a pair of longitudinal structural elements 102*a*, 104*a* connected and reinforced by a plurality of perpendicularly oriented brace elements 102*b*, 104*b* and diagonal brace elements 102*c*, 104*c*. Although shown in two dimensions in the figures, the truss members 102 can also be positioned with respect to each other so that the truss assembly 100 itself has an overall triangular, square (see, e.g., FIGS. 7*a-c*, 8*a-c*), or other geometric shape in cross-section. Such three-dimensional configurations may increase the tensile, torsional and/or shear strength of the assembly 100. Additionally, such three-dimensional truss members 102, 104 could be made large enough and spaced far enough apart from one another that personnel could walk from ship-to-ship through the opening defined by the truss members. Likewise, materials transfers could also be made through the truss members. The top surfaces of the truss members 102, 104 also might be utilized for material movement or for support of liquid transfer devices such as hoses or pipes.

It is further noted that although only a single truss assembly 100 is shown, it is contemplated that more than one assembly may be used to rigidly connect the first and second ships 1000, 2000. Thus, in one embodiment, one truss assembly may be located near the bow of the ship 1000 and one near the stem. Likewise, a pair of receptacle assemblies 300 may be located in corresponding locations on the second ship 2000. For connecting larger ships, three or more truss assemblies 100 may be required.

Figure 4:
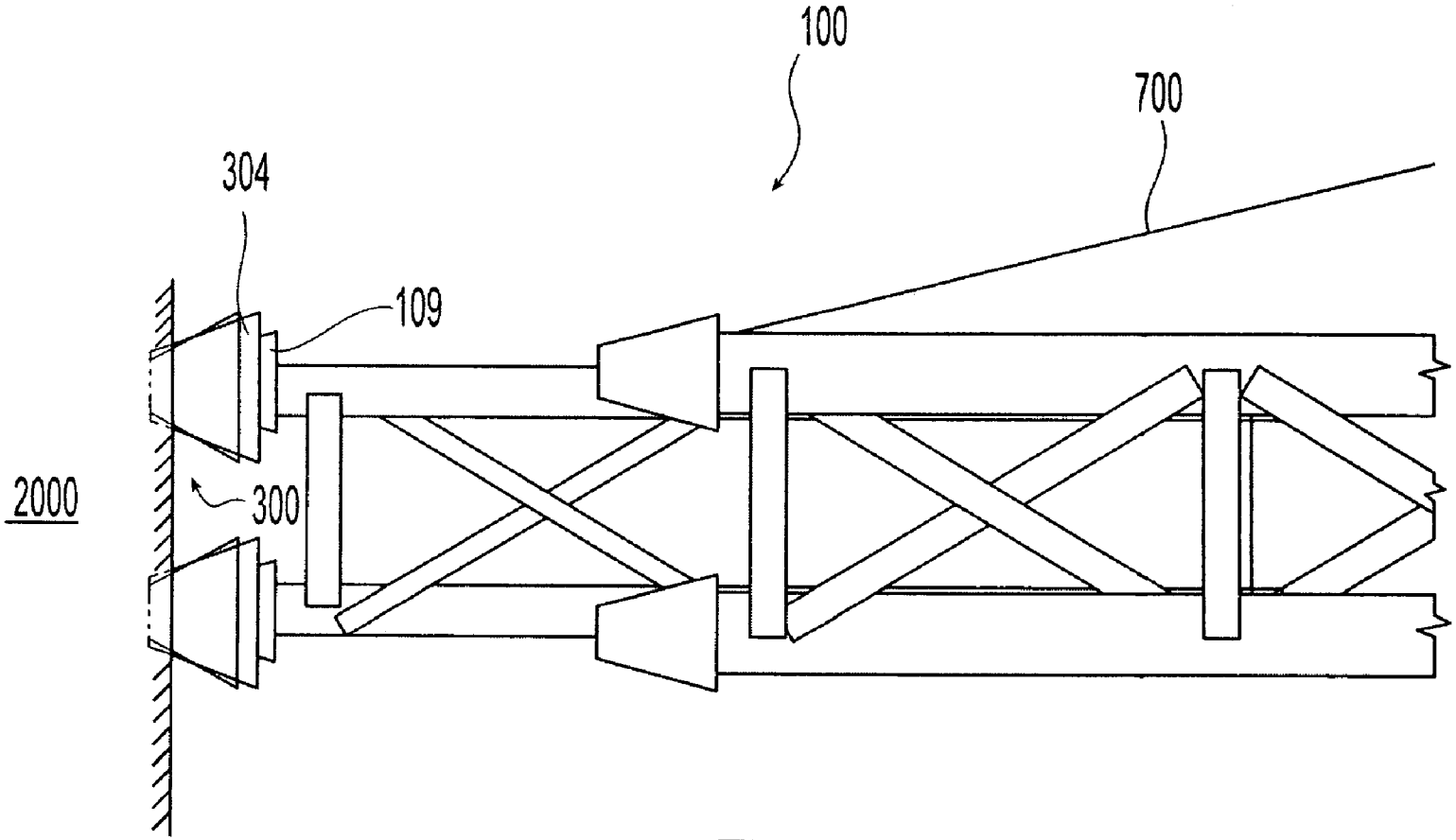
FIG. 4 is a partial side view of the pair of truss members fully engaged with the receptacle arrangement of FIG. 3.
Figure 5:
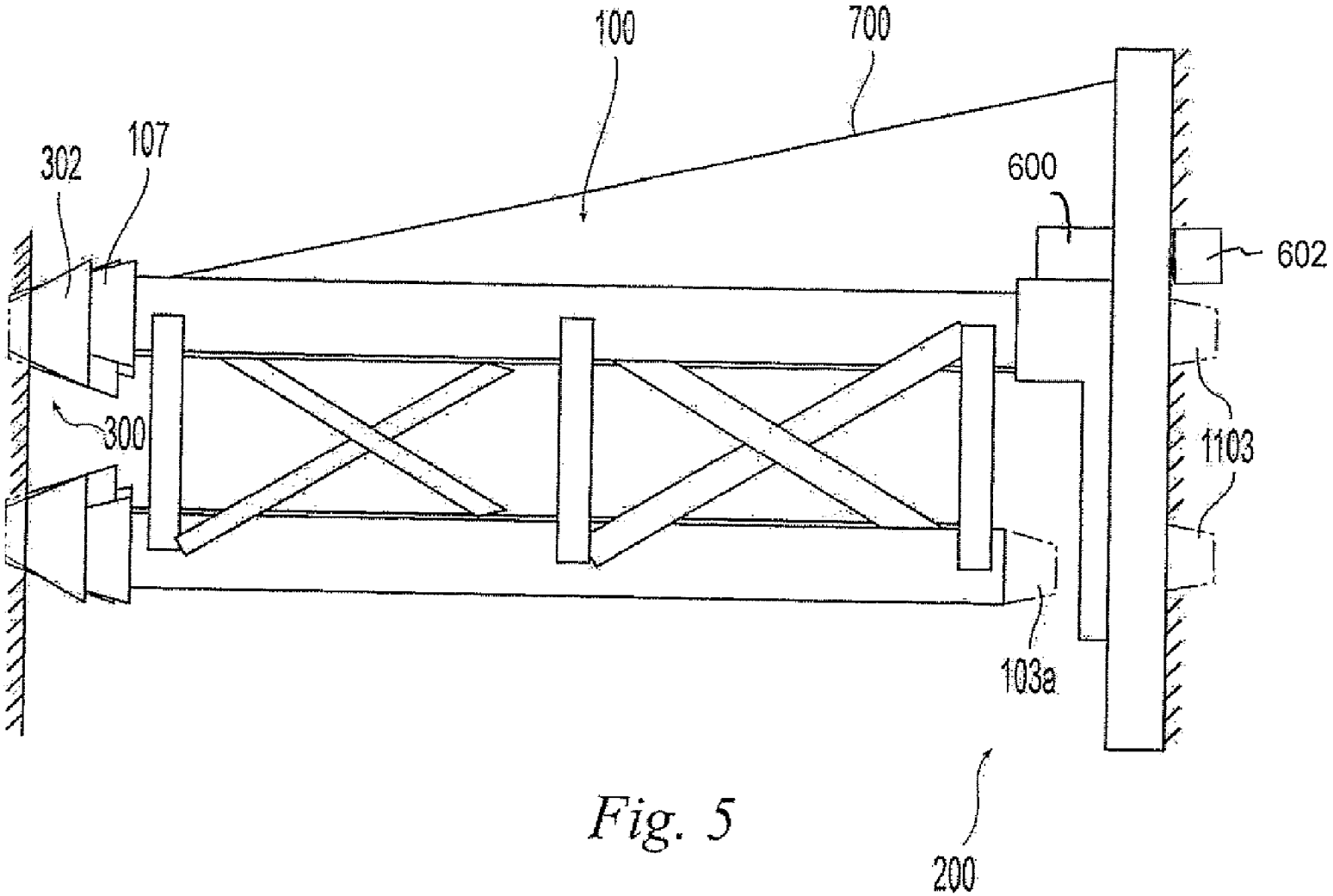
FIG. 5 is a side view of the truss members of FIG. 1 fully engaged with the receptacle arrangement of FIG. 3, the truss members being in a partially retracted position.

A plurality of cables 500 may be provided within the truss assembly 100 for drawing the assembly into mating alignment with the receptacle elements 302, 304. In the illustrated embodiment, cables 500 are disposed within the longitudinal structural elements 104*a* of the second truss member 104 so that one end of each cable extends distally from the coupling member 109 associated with each element 104*a*. The cables can be transferred from the first ship to the second ship using known techniques, such as using a gun to propel a rope from one ship to the other (the cable being connected to the rope). The cable can then be connected to the respective receptacles 304 or to appropriate structure located adjacent the receptacles. One or more winches 600 (FIGS. 3-4) located on the first ship 1000 (the supplying ship) may then be used to tighten the cables 500 to draw the coupling members 109 into provisional engagement with the receptacles 304 (FIGS. 3-4). The winches 600 could be mounted either in the distal end of the truss assembly 100, or within the first ship 1000 (the supplying ship), with the cables 500 exiting into the truss assembly 100 through a suitable fairlead. During this provisional engagement phase, shown in FIG. 4, the adjustment assembly 200 may angulate to allow the ships to continue to move with respect to each other while maintaining the engagement between the truss assembly 100 and the receptacle assembly 300.

Figure 7A:
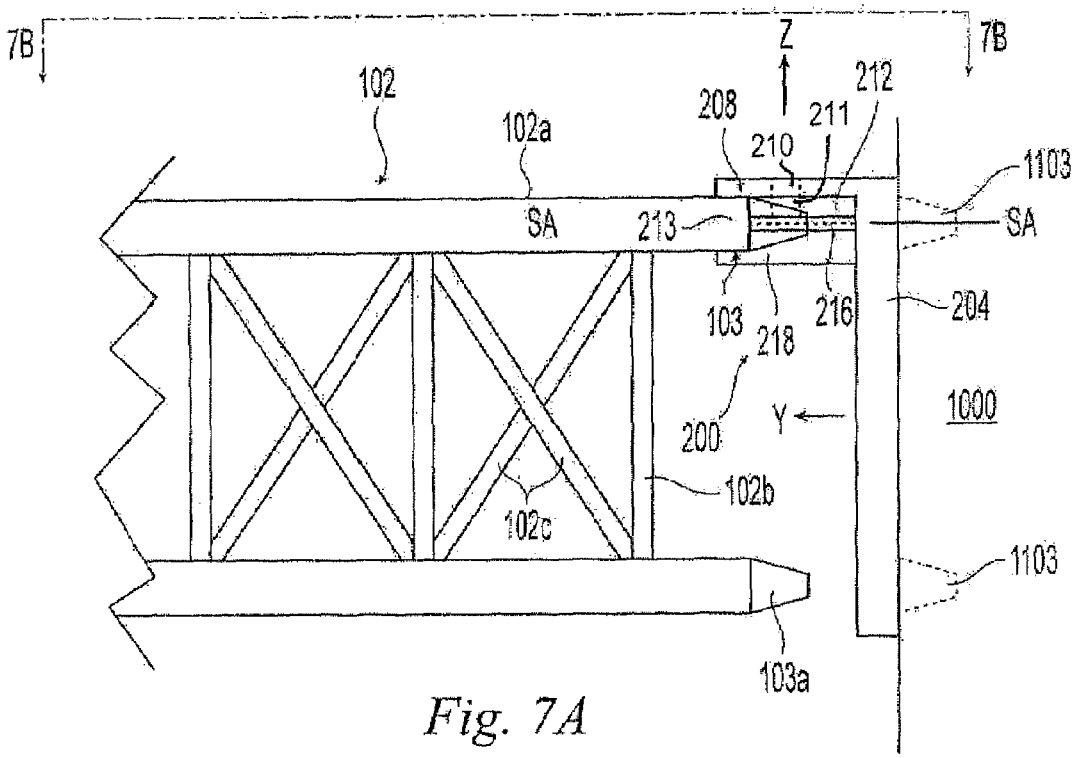
FIGS. 7*a*, 7*b* and 7*c* are side, top and end views, respectively, of an articulation mechanism for use with the truss members of FIG. 1.
Figure 7B:
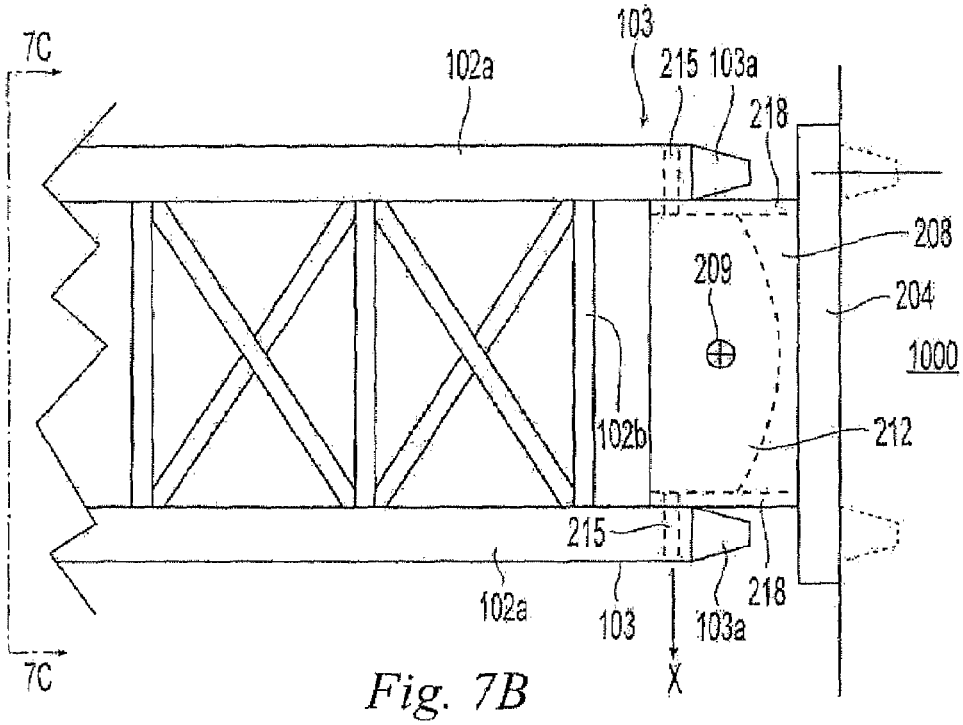
Figure 7C:
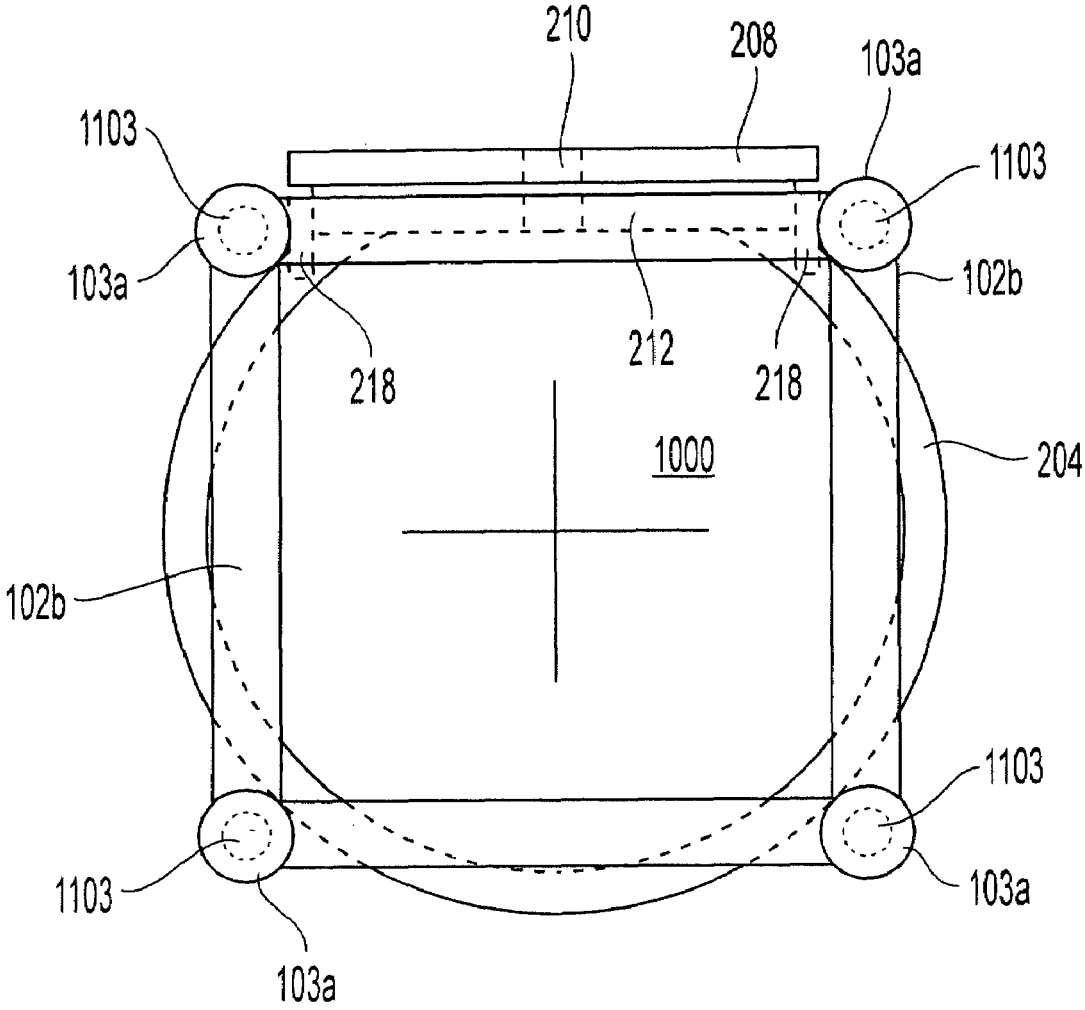

Referring to FIGS. 7*a*, 7*b* and 7*c*, an exemplary adjustment assembly 200 is illustrated for connecting the truss assembly 100 to the first ship 1000. As previously noted, the adjustment assembly 200 may allow the truss assembly 100 to move, with three mutually perpendicular degrees of freedom, with respect to the ship 1000 to thereby allow for a smooth engagement between ships 1000, 2000. The adjustment assembly 200 further may be lockable so that when the desired tight engagement between ships is effected, the two will be fixed rigidly together in a catamaran configuration. Thus, the adjustment assembly 200 may comprise a series of interlinking elements which are engaged and movable with respect to each other to achieve the degrees of articulation desired. As such, the adjustment assembly 200 may comprise a roller bearing 204, a horizontally extending member 208, and an intermediate plate member 212 interlinked in series to provide the desired articulation. The roller bearing 204 may have a first portion that is rigidly attached to the hull of the ship 1000 and a second portion that is connected to the horizontally extending member 208. The roller bearing 204 may have an axis of rotation "y" oriented parallel to the ship's pitch axis, thus allowing the horizontally extending member 208 to rotate with respect to the ship about the "y" axis. The horizontally extending member 208 may further be rotatably connected to the intermediate plate member 212 via a pinned connection. The pinned connection may comprise a vertically oriented pin 209 which is received within a correspondingly shaped bores 210, 211 formed in the horizontally extending member 208 and the plate member 212. The vertically oriented pin 209 may have an axis of rotation "z" that is oriented substantially parallel to the ship's yaw axis to allow the horizontally extending member 208 and the intermediate plate member 212 to rotate with respect to each other about the "z" axis. The intermediate plate member 212 may itself be linked to the first ends 103 of the truss member via a pair of laterally extending pins 213, each of the pins being oriented to provide an axis of rotation "x" that is oriented substantially parallel to the ship's roll axis. One end of each laterally extending pin 213 may further be disposed within a correspondingly shaped bore 215 formed in the first ends 103 of the truss member 102, and a second end of each laterally extending pin 213 may be disposed within a corresponding slot 216 formed in a pair of vertically-oriented portions 218 of the plate member 212. The slots 216 may each have an axis SA-SA that is oriented substantially parallel to the extension axis A-A of the truss assembly 100, thus allowing the pins 213 and the associated truss member 102 to: (a) rotate about the "x" axis with respect to the intermediate plate member 212, and (b) slide along the extension axis A-A with respect to the intermediate plate member 212. Thus arranged, the truss assembly is capable of rotating with respect to the ship about the pitch, roll and yaw axes. In addition, the truss assembly 100 is slidable along the extension axis A-A with respect to the ship 1000.

Figure 8A:
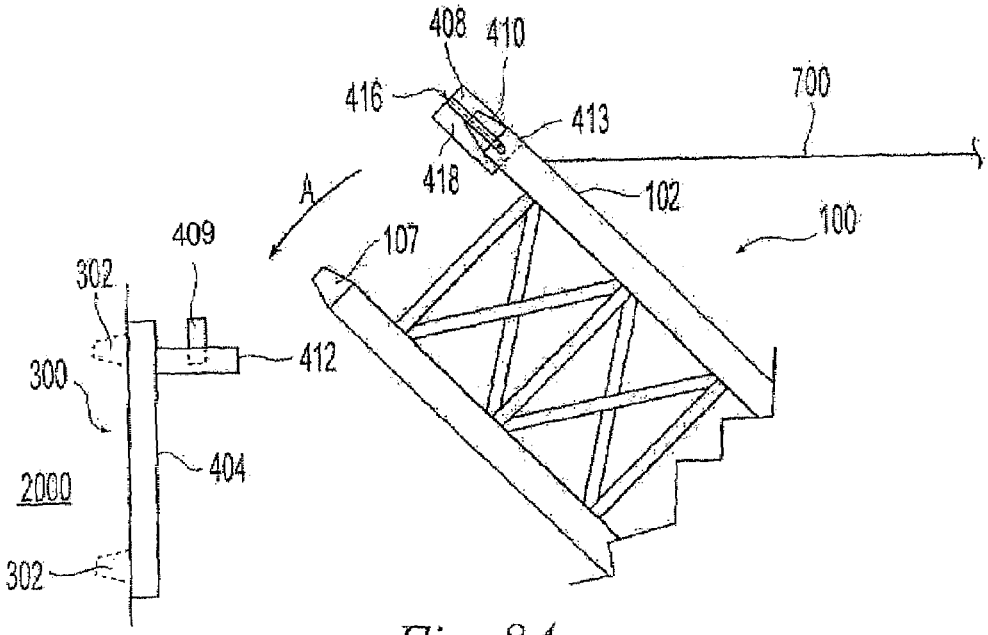
FIGS. 8*a*, 8*b* and 8*c* are side, top and end views, respectively, of a second articulation mechanism for use with the truss members of FIG. 1.
Figure 8B:
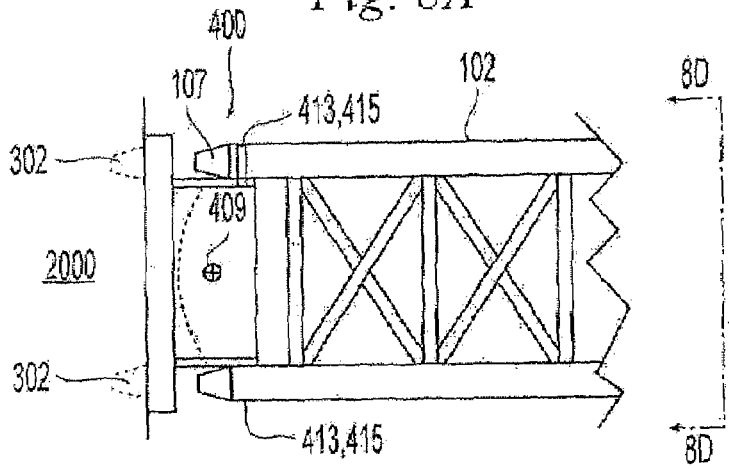
Figure 8C:
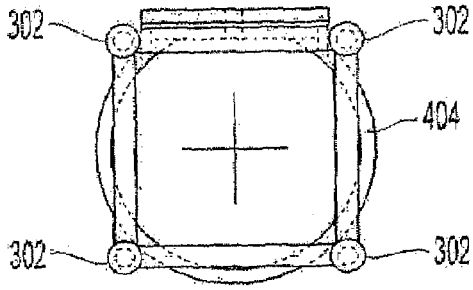

As previously noted, and in order to provide an added measure of adjustability, the receptacle assembly 300 may also be adjustably mounted to its respective ship 2000 using an adjustment assembly 400. Referring to FIGS. 8*a*, 8*b* and 8*c*, adjustment assembly 400 is illustrated for use in adjustably mounting the receptacle assembly 300 to ship 2000. As can be seen, the adjustment assembly 400 may have substantially the same construction as adjustment assembly 200, with the principal exception being that the horizontally extending member 408 and the intermediate plate member 412 may be freely releasable from each other to allow the truss assembly 100 to be engaged with, and disengaged from, the receptacle assembly 300 as desired.

For purposes of clarity, the second truss member 104 has not been shown in FIGS. 8*a-c*, although it will be appreciated that it remains part of the system. FIG. 8*a* shows a disengaged configuration of the assemblies, in which the roller bearing 404, the intermediate plate member 412 and the vertically oriented pin 409 are connected to the second ship 2000, while the horizontally extending member 408 is separately engaged with the truss member 102. To deploy the system, the truss assembly 100 may lower using cable 700 until the bore of the horizontally extending member 408 receives the pin 409 of the intermediate plate member 412. Once the pieces are engaged, the adjustment assembly 400 enables articulation of the truss assembly 100 with respect to the ship 2000 in the same manner as previously described in relation to adjustment assembly 200 and ship 1000.

Figure 6:
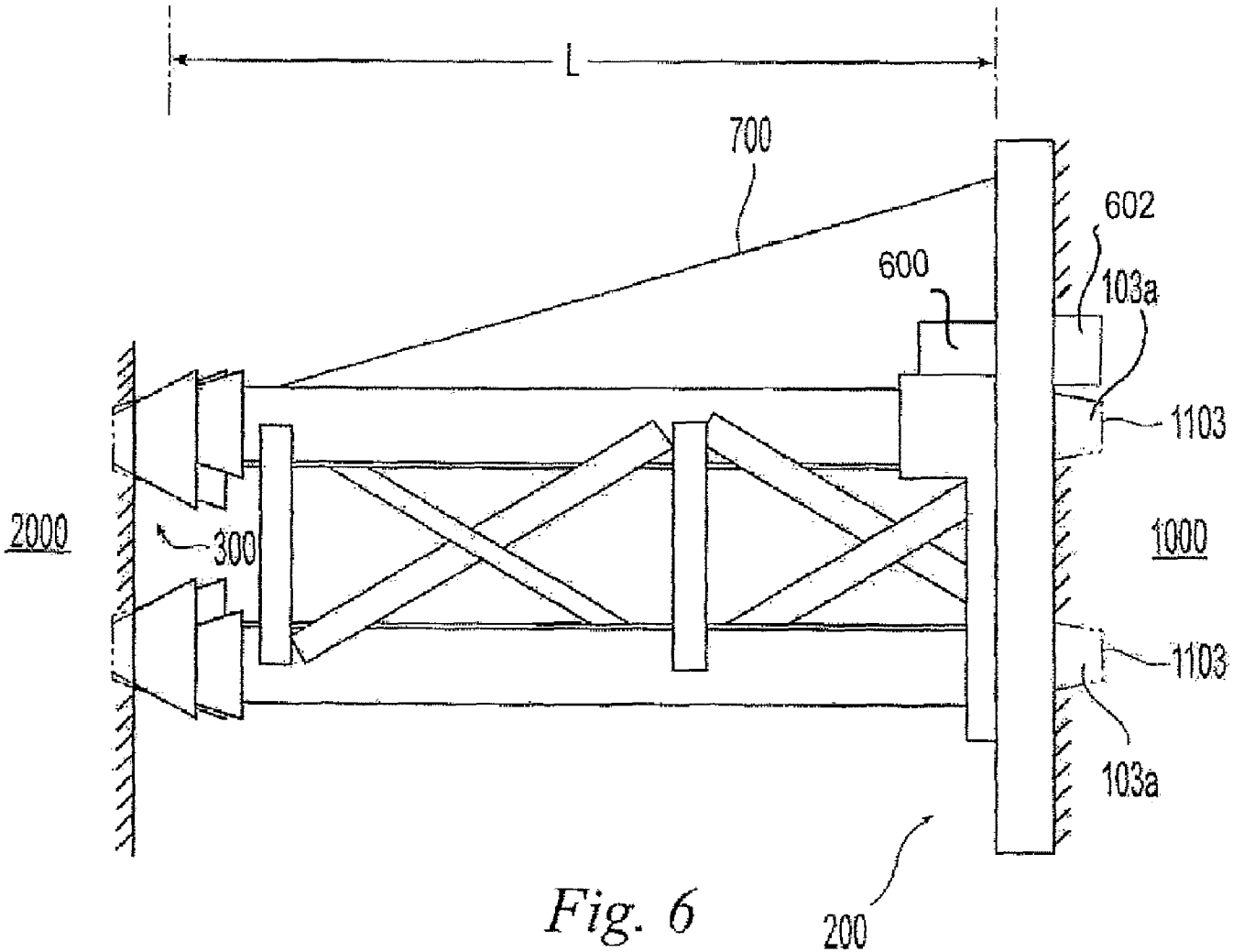
FIG. 6 is a side view of the truss members of FIG. 1 fully engaged with the receptacle arrangement of FIG. 3, the truss members being in a fully retracted and locked position.

For the embodiment in which only one adjustment assembly (200) is provided, once the coupling members 109 of the second truss member 104 are provisionally engaged with their respective receptacles 304, the winches 600 can be used to gradually draw the coupling members 107 of the first truss member 102 into the associated receptacles 302. Again, at this point, the adjustment assembly 200 still allows the truss assembly 100 to angulate with respect to the ships. Once the coupling members 107, 109; 302, 304 of the truss and receptacle assemblies are fully engaged, a hydraulic ram system 602 located on the supplying ship 1000 (i.e., the ship to which the truss assembly 100 is permanently attached) may be used to compress the truss assembly, gradually telescoping the second truss member 104 into the first truss member 102, thereby reducing the total effective length "L" of the truss assembly 100 and drawing the ships 1000, 2000 into closer relation. In addition to forcing the coupling members 107, 109; 302, 304 together, this telescoping process also forces the first ends 103 of the first truss members 102 to slide within the slots 216 of the adjustment assembly 200 until the conic ends 103*a* are received in correspondingly shaped recesses 1103 associated with the ships hull. Thus, when the truss assembly assumes the configuration shown in FIG. 6, it is in its most compact form (i.e. it can not be shortened any further). The tight contact between the coupling members 107, 109; 302, 304 of the truss and receptacle assemblies 100, 300 (for ship 2000) and between the conic ends 103*a* and the recesses 1103 of the ship hull (for ship 1000) also causes the adjustment assembly 200 to "freeze" or lock in place, thus preventing any further articulation. Cargo or other transfers can then be undertaken between the ships.

For the embodiment of FIGS. 8*a-c*, in which a pair of adjustment assemblies 200, 400 are provided, the truss assembly must first be coupled to the adjustment assembly 400. This may be done by lowering the distal end of the truss assembly 100 down onto the intermediate plate member 412 so that the vertically extending pin 409 engages the bore 410 in the horizontally extending member 408. The cables 500 and/or hydraulic ram 602 may then be used to gradually telescope the second truss member 104 into the first truss member until the two can not be telescoped further. Thereafter, the hydraulic ram 602 may be used to draw together the associated coupling members (as well as the conic ends 103*a* and recesses 1103) of the truss and receptacle assemblies (107, 109; 203, 304; 103*a*, 1103) to "freeze" or lock the adjustment assemblies 200, 400 in placed, thus preventing any further articulation.

Regardless of the number of adjustment assemblies used, the ultimate compact form of the truss assembly 100 provides the strength necessary to fix the ships together in a substantially rigid manner to form the catamaran previously described. In one embodiment, the total effective length "L" will be about 20 feet when the truss assembly 100 is in its fully retracted (i.e. compact) configuration. In this configuration, the ships will be fixed relative to each other, so that waves and sea surges will move both ships together rather than independently. As a result, cranes operating on either ship 1000, 2000 can transfer cargo between the ships without needing to compensate for dynamic changes in relative height and other positional differences between the decks of the two ships that would exist were the ships free to move with respect to each other.

The invention will find application in a variety of sea-based applications where it is desirable to transfer cargo between ships, and between ships and platforms, including U.S. Merchant Marine cargo and container ships.

It is expected that the first ship 1000 will be the supplying ship, and will have the truss assembly 100 attached thereto, along with winch or winches 600, truss guidance control equipment (e.g. laser guiding system 604), and hydraulic ram equipment 602. The truss assembly 100 preferably will be positioned in a recessed or "swung-away" configuration. The second ship 2000 will appropriately be the receiving ship, and will thus have the receptacle assembly 300, primarily because it will require less space on board the ship and would also be cheaper to provide to a large number of ships throughout a fleet.

To deploy the system, the truss assembly 100 can be unstowed and extended into the position of FIG. 2, by lowering or swinging the assembly 100 using of one or more cables 700 attached to an appropriate portion of the truss assembly (in the illustrated case the cable 700 is attached to the first truss member adjacent coupling members 107). The second ship 2000 could then come along side the first ship so that the receptacle assembly 300 is roughly positioned opposite the coupling member 109 of the truss assembly 100. An initial standoff distance of about 50-75 feet between the two assemblies is expected. The cables 500 can then be dispensed from the ends of the coupling members 109. As previously noted, the cables can be attached to ropes which can be propelled from ship to ship using a known technique. The cables 500 would be received by operators located on the first or second ship 1000, 2000, who would engage them with the associated receptacles 304 and at least one winch 600. Preferably, the winches 600 will be located on the first ship 1000, which is the supplying ship. The winch 600 would then be operated to retract the cables 500, causing the coupling members 109 to be drawn into engagement with the receptacles 304. The remainder of the engagement procedure would proceed as previously described, the details of which may depend on whether one or two adjustment assemblies are provided.

As will be appreciated, a combination of winches 600 and hydraulic rams 602 may be used to achieve the desired telescoping (retraction) of truss members 102, 104, as well as the coupling and locking of the truss assembly 100 between the ships 1000, 2000. In one embodiment, the total effective length "L" of the truss assembly will be about 20 feet when the first truss member 102 is fully retracted with respect to the second truss member 104. Where more than one truss assembly is provided, the above method would be performed simultaneously for all assemblies.

As an alternative to the cable and winch system described above for initiating engagement between the truss and receptacle assemblies 100, 300, a laser guidance system 604 could be used to position the coupling members 109 of the truss assembly within the corresponding receptacles 304. Thus, a laser scanner can be mounted on the first ship 1000 or on the truss assembly 100 with a clear view of the receptacles 304 on the second ship 2000, to which a plurality of targets can be mounted. The targets can comprise reflective tape, cylinders or plates. The scanner can measure the distance and angle to each target and provide the coordinates to a control program. The control program, in turn, can adjust the position of the truss assembly to place the coupling members 109 into engagement with the receptacles 304.

Alternatively, a manual control system could be used to position the truss. For example, a joystick controlled system could be used, and visual adjustments made by the operator or with the assistance of other personnel using binoculars or other viewing equipment.

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

The invention claimed is:

1. A system for connecting first and second floating bodies, the system comprising:

a truss assembly associated with the first floating body, the truss assembly having a plurality of telescoping truss portions and a longitudinal axis, a first truss portion of the plurality of telescoping truss portions being slidably connected to a second truss portion of the plurality of telescoping truss portions for motion in the direction of the longitudinal axis, the second truss portion being connected at a proximal end thereof to the first floating structure via an adjustment assembly, the adjustment assembly being configured to allow the truss assembly to rotate about three mutually perpendicular axes with respect to the first floating body; and a receptacle assembly connected to the second floating body;

wherein the first truss portion further has a coupling disposed at a distal end thereof and the receptacle assembly further comprises a receptacle for receiving the coupling to connect the first and second floating bodies together; and wherein the truss assembly has an extended position with a first length and a retracted position with a second length, the truss assembly being configurable in the extended position for engaging the receptacle assembly connected to the second floating body, the truss assembly further being configurable to the retracted position for locking the first and second floating bodies together to prevent substantial relative movement therebetween;

wherein the coupling of the first truss portion comprises a plurality of coupling elements and the receptacle assembly comprises a plurality of corresponding recesses configured to receive the coupling elements.

2. The system of claim 1, wherein each of the first and second truss portions comprises at least a pair of longitudinal structural elements connected by a plurality of brace elements.

3. The system of claim 1, further comprising a cable and winch, the cable being associated with one of the coupling elements, the cable further being receivable within one of the recesses to guide the coupling element into engagement with the recess using the winch.

4. The system of claim 3, wherein the truss assembly is movable between the extended and retracted positions by a hydraulic ram system.

5. The system of claim 1, wherein the receptacle assembly further comprises an adjustment assembly, the adjustment assembly being configured to allow the receptacle assembly to rotate about three mutually perpendicular axes with respect to the second floating body.

6. The system of claim 5, further comprising a laser guidance system for automatically controlling the position of the truss assembly, the laser guidance system comprising a laser scanner connected to the first floating body and a reflective target connected to the receptacle assembly;

wherein the laser scanner measures the distance and angle to each target and provides coordinates to a control program to enable adjustment of the position of the truss assembly to place the coupling members into engagement with the receptacles.

7. The system of claim 1, wherein the truss assembly comprises a plurality of longitudinal structure members, the assembly having a central opening substantially aligned with the longitudinal axis of the assembly, the central opening being sized to allow personnel to pass between the first and second floating structures via the opening.

8. A system for connecting first and second floating bodies, the system comprising:

a truss portion connected to the first floating body via a first adjustable assembly, and a receptacle portion connected to the second body via a second adjustable assembly;

wherein the truss portion further comprises first and second truss members, the first truss member having a first end slidably engaged with the second truss member and a second end having a coupling element for engaging a corresponding recess in the receptacle portion;

wherein the first and second adjustable assemblies are each configured to allow movement about three mutually perpendicular axes; and wherein the truss portion has an extended position with a first length and a retracted position with a second length, the truss portion being configurable in the extended position for engaging the receptacle portion connected to the second floating body, the truss portion further being configurable to the retracted position for locking the first and second floating bodies together to prevent substantial relative movement therebetween.

9. The system of claim 8, wherein the first truss member comprises a plurality of coupling elements and the receptacle portion comprises a plurality of corresponding recesses configured to engage the plurality of coupling elements.

10. The system of claim 9, further comprising a cable and winch, the cable being disposed adjacent one of the coupling elements, the cable further being receivable within one of the recesses to guide the coupling element into engagement with the recess using the winch.

11. The system of claim 10, wherein the truss portion is movable between the extended and retracted positions by a hydraulic ram.

12. The system of claim 8, wherein the receptacle portion further comprises an adjustment assembly, the adjustment assembly being configured to allow the receptacle portion to rotate about three mutually perpendicular axes with respect to the second floating body.

13. The system of claim 12, further comprising a laser guidance system for automatically controlling the position of the truss assembly, the laser guidance system comprising a laser scanner connected to the first floating body and a reflective target connected to the receptacle assembly;

wherein the laser scanner measures the distance and angle to each target and provides coordinates to a control program to enable adjustment of the position of the truss assembly to place the coupling members into engagement with the receptacles.

14. The system of claim 8, wherein the truss assembly comprises a plurality of longitudinal structure members, the assembly having a central opening substantially aligned with the longitudinal axis of the assembly, the central opening being sized to allow personnel to pass between the first and second floating structures via the opening.

15. A method of connecting first and second floating bodies, comprising:

providing a first ship with a truss assembly comprising first and second telescopically interrelated truss members, the truss assembly having an extended position and a retracted position;

providing a second ship with a receptacle assembly comprising an engaging member for engaging the truss assembly;

configuring the truss assembly to the extended position;

engaging the truss assembly with the engaging member of the receptacle assembly;

locking the truss assembly to the receptacle assembly; and configuring the truss assembly to the retracted position, thereby locking the first and second floating bodies together to prevent substantial relative movement therebetween;

wherein the truss assembly further comprises an adjustment assembly to allow the truss assembly to move about three mutually perpendicular axes with respect to the first ship; and the receptacle assembly further comprises an adjustment assembly to allow the receptacle assembly to move about three mutually perpendicular axes with respect to the second ship.

16. The method of claim 15, wherein the engaging step comprises engaging a cable with a distal end of the truss assembly, engaging the cable with the engaging member of the receptacle assembly, and using a winch to draw the distal end of the truss assembly into engagement with the engaging member.

17. The method of claim 15, wherein each of the first and second telescopically interrelated truss members comprises at least a pair of longitudinal structural elements connected by a plurality of brace elements.

18. The method of claim 15, wherein the engaging step comprises using a laser guiding system to guide the truss assembly into engagement with the engaging member of the receptacle assembly.

19. The method of claim 15, wherein the truss assembly is movable between the extended and retracted positions by a hydraulic ram.

20. The method of claim 15, wherein the truss assembly has a central opening substantially aligned with the longitudinal axis of the assembly, the central opening being sized to allow personnel to pass between the first and second floating structures via the opening.

* * * * *